US006796891B2

(12) United States Patent
Terada

(10) Patent No.: US 6,796,891 B2
(45) Date of Patent: Sep. 28, 2004

(54) GRINDING WHEEL, A PROCESS OF MANUFACTURING THE GRINDING WHEEL AND A PROCESS OF RECLAIMING THE GRINDING WHEEL

(75) Inventor: Yoshiharu Terada, Nissin (JP)

(73) Assignee: Noritake Co., Ltd., Nagoya (JP)

( * ) Notice: Subject to any disclaimer, the term of this patent is extended or adjusted under 35 U.S.C. 154(b) by 31 days.

(21) Appl. No.: 10/206,337

(22) Filed: Jul. 29, 2002

(65) Prior Publication Data

US 2003/0032384 A1 Feb. 13, 2003

(30) Foreign Application Priority Data

Aug. 1, 2001 (JP) ..... 2001-233140

(51) Int. Cl.[7] ..... B24B 5/00
(52) U.S. Cl. ..... 451/541; 451/542
(58) Field of Search ..... 451/541, 548, 451/415, 542, 544; 51/293, 295, 307

(56) References Cited

U.S. PATENT DOCUMENTS 3,800,483 A * 4/1974 Sherman ..... 451/508
4,037,367 A * 7/1977 Kruse ..... 451/551
4,088,729 A * 5/1978 Sherman ..... 264/259
5,584,755 A 12/1996 Alfer et al.

FOREIGN PATENT DOCUMENTS

| | | | |
|---|---|---|---|
| JP | 50-47289 | 4/1975 | |
| JP | 02-048173 | 2/1990 | |
| JP | 04-217462 | 8/1992 | |
| JP | 06-091535 | 4/1994 | |
| JP | A 2000-6029 | 1/2000 | |
| JP | 02000079565 A * | 3/2000 | ..... 451/541 |

* cited by examiner

*Primary Examiner*—Lee D. Wilson
(74) *Attorney, Agent, or Firm*—Oliff & Berridge, PLC

(57) ABSTRACT

A grinding wheel comprising an outer annular grinding portion, and an inner core portion which is located radially inwardly of the annular grinding portion to support the annular grinding portion and which is formed of a composition including as a major component a thermoplastic resin having a specific tensile strength of at least 12 MPa. The grinding wheel is manufactured in a process including a step of crushing the core portion of the used grinding wheel into pellets to be reclaimed as a material for the core portion, a step of preparing a composition for the core portion, which includes a mass of the pellets and a fresh thermoplastic resin having a specific tensile strength of at least 12 MPa, and a step of forming the core portion by using the composition in a molten state. The process may further include a step of reclaiming the grinding portion of the used grinding wheel.

10 Claims, 6 Drawing Sheets

FIG. 3

| | SPECIMEN NO. | THERMOPLASTIC RESIN | AGGREGATE | VOL.% OF AGGREGATE | SPECIFIC GRAVITY | TENSILE STRENGTH (MPa) | ELASTIC MODULUS (GPa) | SAFETY FACTOR |
|---|---|---|---|---|---|---|---|---|
| SPECIMENS OF THE EMBODIMENT | 1 | NYLON | NONE | - | 1.2 | 51 | 3.5 | 2.11 |
| | 2 | PET | NONE | - | 1.3 | 60 | 3.4 | 2.15 |
| | 3 | PC | NONE | - | 1.2 | 45 | 2.5 | 2.08 |
| | 4 | NYLON | ALUMINA GRAIN SIZE #100 | 60 | 1.6 | 75 | 8.1 | 2.30 |
| | 5 | PET | ALUMINA GRAIN SIZE #100 | 60 | 1.6 | 80 | 9.0 | 2.30 |
| | 6 | PET | ALUMINA GRAIN SIZE #100 | 40 | 1.57 | 76 | 7.7 | 2.25 |
| | 7 | PET | ALUMINA GRAIN SIZE #100 | 30 | 1.52 | 74 | 6.6 | 2.22 |
| | 8 | PET | ALUMINA GRAIN SIZE #100 | 20 | 1.45 | 70 | 4.5 | 2.18 |
| | 9 | PET | ALUMINA GRAIN SIZE #100 | 10 | 1.42 | 62 | 3.8 | 2.15 |
| COMPARATIVE SPECIMENS | 1 | VITRIFIED | ALUMINA GRAIN SIZE #100 | - | 2.5 | 30 | 40 | 2.30 |
| | 2 | VITRIFIED | ALUMINA GRAIN SIZE #80 | - | 2.5 | 33 | 40 | 2.20 |
| | 3 | VITRIFIED | ALUMINA GRAIN SIZE #60 | - | 2.5 | 32 | 40 | 2.18 |
| | 4 | VITRIFIED | ALUMINA GRAIN SIZE #46 | - | 2.5 | 28 | 36 | 2.15 |

FIG. 4

| | COMPARATIVE SPECIMEN NO. 5 | SPECIMEN NO. 10 ACCORDING TO THE EMBODIMENT |
|---|---|---|
| GRINDING RATIO (−) | 30 | 34 |
| SURFACE ROUGHNESS (μmRz) | 3.5 | 2.8 |
| POWER CONSUMPTION (W/mm) | 8.2 | 6.6 |

GRINDING WHEEL, A PROCESS OF MANUFACTURING THE GRINDING WHEEL AND A PROCESS OF RECLAIMING THE GRINDING WHEEL

This application is based on Japanese Patent Application No. 2001-233140 filed on Aug. 1, 2001, the contents of which are incorporated hereinto by reference.

BACKGROUND OF THE INVENTION

1. Field of the Invention

The present invention relates in general to a grinding wheel having an outer annular grinding portion and an inner core portion located radially inwardly of the grinding portion and functioning primarily to support the grinding portion, and a process of manufacturing the grinding wheel and a process of reclaiming the grinding wheel.

2. Discussion of Related Art

Annular grinding wheels are widely used in various fields of industry, for performing a grinding operation by rotation of the grinding wheel. Examples of such annular grinding wheels include a vitrified-bond wheel wherein abrasive grains are held together with an inorganic bonding material, and a resinoid-bond wheel wherein the abrasive grains are held together with a synthetic resin. In the annular grinding wheel manufactured in the prior art, an inner portion of the grinding wheel is generally formed, as a core portion integrally with the outer grinding portion, of the same material as the annular grinding portion. When the service life of the grinding wheel has been reached with a considerable amount of wear of the outer grinding portion, the entirety of the grinding wheel is discarded, so that the material of the inner core portion which has not been used for the grinding operations is wasted, without reusing or reclaiming the inner core portion.

On the other hand, there has been developed a grinding wheel consisting of an outer annular grinding portion, and an inner core portion which is located radially inwardly of the outer annular grinding portion and functioning primarily to support the grinding portion. Examples of this type of grinding wheel include a grinding wheel having a central core portion formed of a steel, aluminum or other metallic material as disclosed in JP-A-50-47289, and a grinding wheel having a central core portion formed of a thermosetting resin. These grinding wheels provide an improvement in the strength of the core portion. The present inventor made a research on a possibility of reclaiming the grinding wheel, by separating the outer annular grinding portion and the inner core portion from each other, after the service life of the grinding wheel has been reached with a considerable amount of wear of the outer grinding portion. This research was made in an effort to find a practical way of reusing the core portion of the grinding wheel, in view of a recent increasing need for recycling the materials in various fields of technology, to reduce the amount of discarding of the materials and avoiding an abuse of the natural resources.

However, it is relatively costly to reuse the metallic core portion, since the reuse requires treatments or finishing operations to eliminate pits or other damages on the surfaces of the metallic core portion, which have been generated during a long use of the grinding wheel. On the other hand, the reuse of the core portion formed of a thermosetting resin is conventionally considered substantially impossible since it is difficult to recover the original properties of the thermosetting resin once it is deteriorated. Thus, practical methods for reusing or reclaiming the grinding wheel are not available in the prior art.

SUMMARY OF THE INVENTION

It is therefore a first object of the present invention to provide a grinding wheel which has an outer annular grinding portion and an inner core portion located radially inwardly of the annular grinding portion and functioning primarily to support the annular grinding portion, and which can be effectively reclaimed. A second object of the invention to provide a process of manufacturing such a grinding wheel. A third object of the invention is to provide a process of reclaiming the grinding wheel of the type indicated above.

In the prior art, the core portion of the grinding wheel is formed of a metallic material or a thermosetting resin, as described above. The metallic material and thermosetting resin are conventionally selected for the core portion, for their high tensile strength high enough to permit the grinding wheel to be operated under a comparatively severe operating condition, for example, to be rotated at a peripheral speed as high as about 60–80 m/s, for performing a high-speed grinding operation. In selecting the material for the core portion, the present inventor paid attention to the specific tensile strength of the material, which is equal to the tensile strength (MPa) divided by the specific gravity. The inventor found that the use of a material having a specific tensile strength of at least 12 MPa for the core portion enables the core portion to exhibit a strength high enough to withstand a load during a severe grinding operation of the grinding wheel. The inventor further found that the use of a thermoplastic resin having a specific tensile strength for the core portion makes it possible to reclaim or recycle the core portion of the used grinding wheel for manufacturing the core portion of a new grinding wheel, while enabling the core portion to exhibit a sufficiently high strength. The present invention was made in the light of the inventor's findings described above.

The first object indicated above may be achieved according to the first aspect of the principle of this invention, which provides a grinding wheel comprising an outer annular grinding portion, and an inner core portion located radially inwardly of the annular grinding portion to support the annular grinding portion, the core portion being formed of a composition including as a major component a thermoplastic resin which has a specific tensile strength of at least 12 MPa.

The grinding wheel constructed as described above according to the present invention has a sufficiently high strength at its inner core portion. In addition, the core portion of the grinding wheel whose service life has been reached with a considerable amount of wear of the grinding portion can be reused as a material for the core portion of the new grinding wheel. Namely, the used grinding wheel is broken down into the outer grinding portion and the inner core portion, and the core portion is crushed into pellets, which are then heated into a molten state in which the thermoplastic resin can be reclaimed as the material for the core portion of the new grinding wheel. Further, the outer grinding portion of the used grinding wheel can also be reclaimed as a material for the grinding portion of the new grinding wheel, by crushing the grinding portion of the used grinding wheel. The amounts of fresh materials required for forming the grinding and core portions of a new grinding wheel can be significantly reduced by reclaiming the materials of the grinding and core portions of the used grinding wheel, so that the cost of manufacture of the new grinding wheel can be effectively reduced, while the used grinding wheel as a whole can be completely recycled.

Further, the use of the thermoplastic resin for the core portion is effective to improve the grinding ratio of the grinding wheel, smoothness of the workpiece surface ground by the grinding wheel, and economy of electric power consumption by a grinding machine, owing to the higher degree of impact resistance or vibration absorption capacity of the thermoplastic resin than the conventionally used materials such as abrasives, metals, and thermosetting resins. In this respect, the grinding wheel having the core portion formed of the thermoplastic resin according to the present invention is advantageous over the prior art grinding wheel using the above-indicated materials for the core portion.

In one preferred form of the grinding wheel according to the first aspect of this invention, the composition of the core portion includes a fresh thermoplastic resin, and a mass of pellets which is obtained by crushing the core portion of a grinding wheel of the invention a service life of which has been reached. Preferably, the core portion is formed by injecting the composition in a molten state into a mold cavity formed to form the core portion. In the above form of the invention, the core portion of the grinding wheel whose service life has been reached with a considerable amount of wear of the grinding portion is reclaimed as a material for the core portion of the new grinding wheel, so that the grinding wheel can be manufactured at a reduced cost, with reduced amounts of fresh materials required for the grinding wheel, while enabling the core portion to have a sufficiently high strength.

In another preferred form of the grinding wheel of the invention, the thermoplastic resin is selected from a group consisting of engineering plastics including polyamide, polyester and polycarbonate. These engineering plastics which have been used as a material for structural members have a specific tensile strength of at least 12 MPa, and high degrees of resistance to water and oil. In this respect, polyamide, polyester, polycarbonate and other engineering plastics can be suitably used as a major component of the inner core portion of the present grinding wheel.

In a further preferred form of the grinding wheel of the invention, the composition of the core portion further includes, as an aggregate, an inorganic filler such as a glass fiber and an abrasive material. Where the grinding wheel is operated under a relatively severe condition, the core portion of the grinding wheel is required to exhibit relatively high degree of strength and elastic modulus. In this case, the composition of the core portion preferably includes an inorganic filler such as an abrasive material or a glass fiber, in addition to the thermoplastic resin provided as a major component of the composition. The use of the inorganic filler is effective to increase the strength and elastic modulus of the core portion.

The second object indicted above may be achieved according to a second aspect of this invention, which provides a process of manufacturing a grinding wheel having an outer grinding portion and an inner core portion which is located radially inwardly of the annular grinding portion to support the annular grinding portion, the process comprising the steps of;

- crushing the core portion of the grinding wheel into pellets to be reclaimed after a service life of the grinding portion has been reached;
- preparing a composition for forming the core portion, the composition including a mass of the above-indicated pellets and a fresh thermoplastic resin having a specific tensile strength of at least 12 MPa; and
- forming the core portion by using the composition in a molten state.

The process according to the second aspect of this invention not only permits a manufacture of the grinding wheel having the inner core portion which has sufficiently high degrees of mechanical strength and durability, but also makes it possible to reclaim the inner core portion of the used grinding wheel, by separating the grinding and core portions of the used grinding wheel from each other and crushing the core portion into pellets and heating the pellets into a molten mass. The used grinding wheel is a grinding wheel a service life of which has been reached with a considerable amount of wear of the grinding portion. According to the present process, the required amounts of the fresh material for forming the core portion of the new grinding wheel is effectively reduced, so that the cost of manufacture of the grinding wheel is accordingly reduced, owing to the recycling of the used grinding wheel.

The third object indicated above may be achieved according to a third aspect of this invention, which provides a process of reclaiming materials of a grinding wheel having an outer annular grinding portion, and an inner core portion located radially inwardly of the annular grinding portion to support the annular grinding portion, the process comprising the steps of:

- separating the outer annular grinding portion and the inner core portion of the grinding wheel from each other;
- crushing the annular grinding portion into grains of a predetermined size, for reclaiming a mass of the grains as a part of a composition for forming the annular grinding portion of a new grinding wheel; and
- crushing the core portion into pellets, for reclaiming a mass of the pellets as a part of a composition for forming the core portion of the new grinding wheel.

In the process according to the third aspect of this invention, the grinding wheel which has been used for its expected service life is not discarded, but is broken down into the outer grinding and inner core portions, so that the core portion is crushed into a mass of pellets to be reclaimed as a part of the composition for the core portion of a new grinding wheel, while the grinding portion is crushed into a mass of grains of a predetermined size to be reclaimed as a part of the composition for the grinding portion of the new grinding wheel. Accordingly, the amounts of fresh materials required for manufacturing the new grinding wheel are reduced, so that the grinding wheel can be manufactured at a reduced cost, with complete recycling of the used grinding wheel. The present process is significant in the environmental protection.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 3 is a view indicating evaluated physical properties of a core portion of grinding wheels of specimens according to the present invention and comparative specimens, and safety factor values of those grinding wheels obtained in a spin destructive or breaking test;

FIG. 4 is a view indicating a result of a grinding performance test of a specimen according to the present invention and a comparative specimen;

DETAILED DESCRIPTION OF THE PREFERRED EMBODIMENTS

Figure 1:
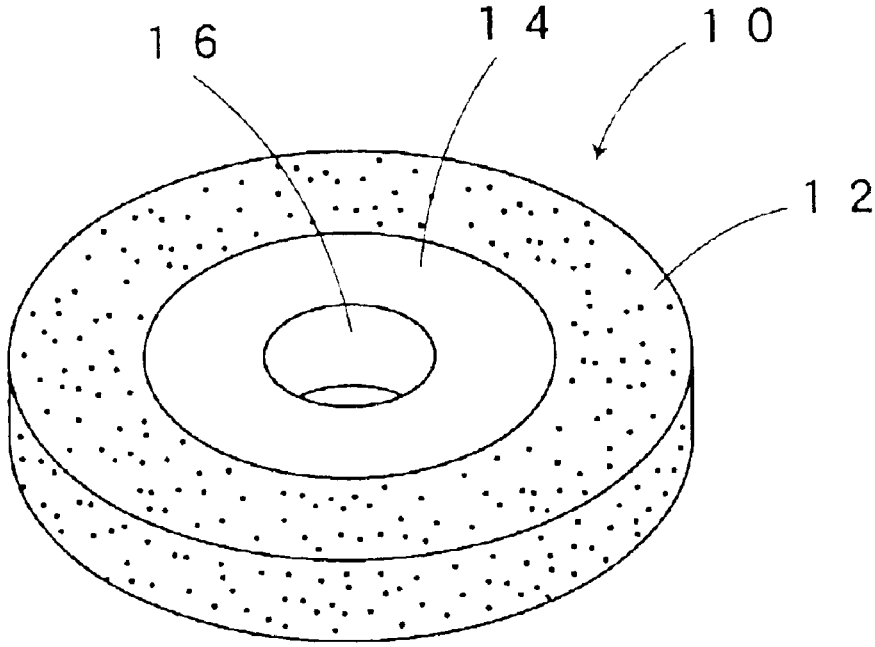
FIG. 1 is a perspective view of a grinding wheel constructed according to one embodiment of this invention.

Referring first to the perspective view of FIG. 1, there is shown a grinding wheel 10 constructed according to one embodiment of this invention. As shown in FIG. 1, the grinding wheel 10 has an outer annular grinding portion 12 and an inner or central annular core portion 14 located radially inwardly of the annular grinding portion 12 and functioning primarily to support the annular grinding portion 12. The annular grinding portion 12 is a porous abrasive structure which consists of abrasive grains that are held together with a glass bonding agent and which functions to perform a grinding operation on a workpiece. The inner core portion 14 is formed of a composition including a thermoplastic resin, as a major component, and has a central mounting hole 16. For example, the abrasive structure of the outer grinding portion 12 is a porous structure of abrasive grains in the form of silicon carbide (SiC) or fused alumina ($Al_2O_3$), which are bonded together with a glassy inorganic bonding material called "vitrified bond" which contains a silicon oxide ($SiO_2$) as a major component, for instance. In a grinding operation of the grinding wheel 10 on the workpiece, the abrasive grains on the surface of the abrasive structure of the grinding portion 12 are gradually fractured and removed as a result of frictional contact with the workpiece, so that the inner abrasive grains having sharp edges are exposed. Thus, the abrasive structure maintains a high degree of grinding sharpness on its grinding surface.

On the other hand, the thermoplastic resin used as the major component of the inner core portion 14 has a specific strength (tensile strength/specific gravity) of at least 12 MPa. The thermoplastic resin preferably has high degrees of water and oil resistance. TABLE 1 given below indicates resistances of representative examples of the thermoplastic resin to water, acid, alkali, oil and solvent. Unless a strong acid or strong alkali substance or an organic solvent is used in the grinding operation, almost all kinds of engineering plastics such as polyamide (nylon 6, nylon 66), polyester (PET, PBT) and polycarbonate can be used as the thermoplastic resin for the inner core portion 14. Further, AS (acrylonitrile-styrene resin) and other quasi-engineering plastics, and polypropylene, polyethylene and other commonly used resins having a sufficiently high strength may also be used as the thermoplastic resin for the core portion 14. It is also noted that the core portion 14 may contain a suitable inorganic filler such as an abrasive material and a glass fiber, depending upon the specific operating condition of the grinding wheel 10.

TABLE 1

| | Water | Resistance to | | | |
|---|---|---|---|---|---|
| Plastics | Absorption (%) | Weak acid | Weak alkali | Oil (gasoline) | Solvent (acetone) |
| Nylon*1 | 1.30–1.90 | Good | Good | Good | Excellent |
| Polycarbonate | 0.15 | Excellent | Good | Fair | Poor |
| AS*2 | 0.20–0.30 | Excellent | Excellent | Excellent | Poor |

TABLE 1-continued

| | Water | Resistance to | | | |
|---|---|---|---|---|---|
| Plastics | Absorption (%) | Weak acid | Weak alkali | Oil (gasoline) | Solvent (acetone) |
| Polypropylene | <0.01 | Excellent | Excellent | Good | Excellent |
| Polyethylene | <0.01 | Excellent | Excellent | Good | Poor |

Evaluation
Excellent: extremely high degree of resistance
Good: sufficiently high degree of resistance
Fair: acceptably high degree of resistance
Poor: not acceptably high degree of resistance
*1: acrylonitrile-styrene resin
*2: nylon 6 and nylon 66

The grinding wheel 10 constructed as described above is mounted at its central mounting hole 16 on a spindle of a grinding machine (not shown), and is rotated about its axis with the outer grinding portion 12 kept in pressing contact with the workpiece held by a suitable clamping device (not shown), while a grinding liquid is applied between the grinding portion 12 and the workpiece. Thus, the workpiece is ground to a desired shape, by the grinding portion 12 of the grinding wheel 10.

Figure 2:
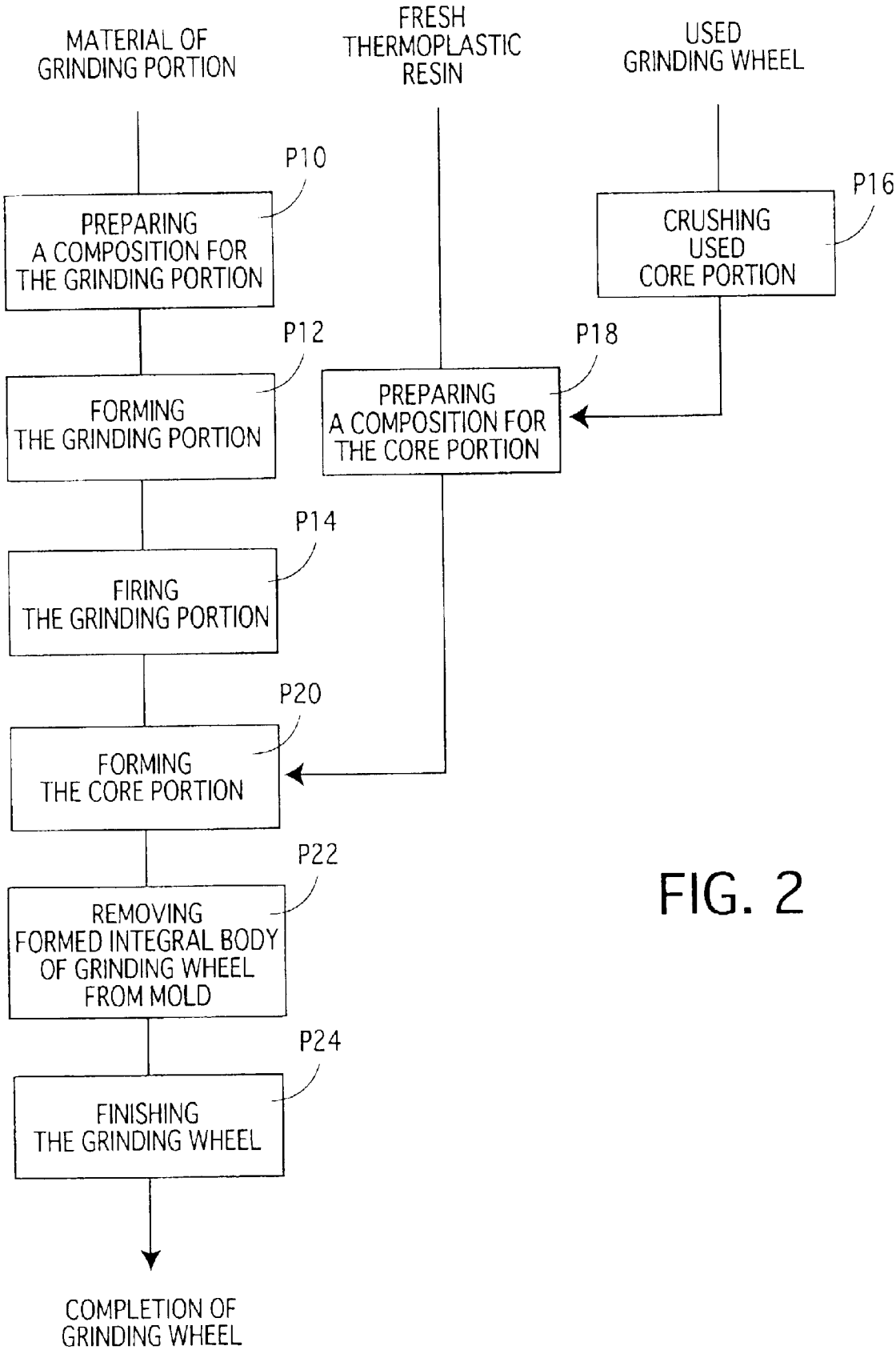
FIG. 2 is a flow chart illustrating a process of manufacturing the grinding wheel of the first embodiment.

Referring to the flow chart of FIG. 2, there is illustrated a process of manufacturing the grinding wheel 10. The process is initiated with step P10 to prepare a material for the grinding portion 12, by mixing together (a) commonly used abrasive grains such as silicon carbide or fused alumina, (b) an inorganic bonding agent (vitrified bond), (c) a binder such as dextrin, and if needed, (d) a pore-forming agent such as walnut particles or inorganic balloon, in a suitable proportion by weight. The inorganic bonding agent is a mixture of particles of silica stone and feldspar, clay and glass frit, which form a glass material whose major component consists of silicon oxide ($SiO_2$). The binder is used to temporarily hold together the abrasive grains during formation of the grinding portion 12 before its firing. For instance, 85 wt. % of abrasive grains in the form of WA (white alundum) having a grain size #60, 8 wt. % of inorganic bonding agent, 6 wt. % of walnut particles and 2 wt. % of dextrin are mixed together by a suitable mixer. Step P10 is followed by step P12 to form an annular structure for the grinding portion 12. Described in detail, a cavity of a mold for forming the grinding portion 12 is filled with the mixture of the abrasive grains, inorganic bonding agent, walnut particles and dextrin, and the mixture is compacted at a comparatively high pressure, by a suitable press, so that the annular structure of the outer grinding portion 12 is press-formed as shown in FIG. 1. Then, step P14 is implemented to fire the formed annular structure in a suitable firing furnace, at about 1300° C., so that the annular structure is sintered into the outer grinding portion 12 of vitrified bond type. For example, the inorganic bonding agent consists of 60 wt. % of $SiO_2$, 20 wt. % of $Al_2O_3$, 5 wt. % of $Na_2O_3$, 5 wt. % of $K_2O$, 3 wt. % of CaO, 2 wt. % of MgO, and 5 wt. % of $B_2O_3$.

In the meantime, step P16 is implemented to reclaim the core portion 14 of the used grinding wheel 10 whose service life has been reached with a considerable amount of wear of its grinding portion 12. That is, the grinding portion 12 and the core portion 14 of the used grinding wheel 10 are separated from each other, and the core portion 14 is crushed into pellets which are reclaimed for forming the core portion 14 of the new grinding wheel 10. Step P16 is followed by step P18 in which a mass of the pellets is mixed with a fresh thermoplastic resin (which has not been used for the core portion 14), so that a composition for the core portion 14 is prepared. For instance, the composition for the core portion 14 is prepared by mixing together 90 vol. % of the fresh thermoplastic resin and 10 vol. % of the pellets obtained from the reclaimed thermoplastic resin. The composition for the core portion 14 to be prepared in step P18, which consists primarily of the thermoplastic resin, may contain, as an aggregate, a suitable amount of an inorganic filler such as abrasive grains and/or glass fiber, where the required strength and elastic modulus of the core portion 14 are comparatively high, that is, where the grinding wheel 10 to be manufactured is intended to be operated in a comparatively severe operating condition, for example, to be rotated at a peripheral speed of about 60 m/s, for performing a high-speed grinding operation. For example, about 40 vol. % of alumina abrasive grains (having a grain size #100) are added per 100 vol. % of the above-indicated composition for the core portion 14.

The outer annular grinding portion 12 obtained in step P14 is transferred by a suitable automatic transfer device, onto a lower half of a core-forming mold, such that the annular grinding portion 12 cooperate with an upper half of the core-forming mold, to define a cavity for forming the inner core portion 14 when the upper half is placed on the lower half so as to close the mold. In step P20, a molten mass of the composition for the core portion 14 which has been prepared in step P18 is injected into the cavity of the core-forming mold, at a sufficiently high temperature of the molten mass, so that the inner core portion 14 is formed integrally with the outer grinding portion 12. During this injection molding of the inner core portion 14, the outer grinding portion 12 is impregnated at its inner circumferential surface, with a suitable amount of the thermoplastic resin of the composition for the core portion 14, whereby the formed inner core portion 14 and the outer grinding portion 12 are bonded together as an integral body. In this respect, it is appreciated that the outer grinding portion 12 is a porous structure of the abrasive grains, so that pores formed in a relatively radially inner portion of this porous structure of the grinding portion 12 are filled with the molten thermoplastic resin having a considerably high degree of viscosity and an accordingly low degree of fluidity, as a result of flow of the molten thermoplastic resin into the pores through the inner circumferential surface of the grinding portion 12, at a sufficiently high injection pressure of the thermoplastic resin. The inner core portion 14 and the outer grinding portion 12 are bonded together after the thermoplastic resin filling the pores in the grinding portion 12 has been cured or solidified. Generally, ceramic materials used as the abrasive grains such as silicon oxide and fused alumina and the thermoplastic resin used for the core portion 14 have a high degree of wettability with respect to each other, and the thermoplastic resin filling the pores in the superficial portion of the grinding portion 12 has an anchoring effect, such that the masses of the thermoplastic resin solidified within the pores serve as wedges, which assure an increased bonding force by which the grinding and core portions 12, 14 are bonded together.

The integral body of the grinding wheel 10 consisting of the outer grinding portion 12 and the inner core portion 14 formed radially inwardly of the grinding portion in the core-forming step P20 is removed from the core-forming mold in the following step P22, and is subjected to a finishing operation in step P24 in which the grinding wheel 10 is cut at its outer surfaces by a dressing or cutting tool, with a depth of cut of about 1–2 mm, so as to establish the nominal outside diameter, thickness, cylindricity, etc. In this respect, it is noted that the outer grinding portion 12 and the inner core portion 14 as formed in the respective forming steps P12 and P20 have external dimensions which are larger than the nominal dimensions by the depth of cut in the finishing step P24.

To confirm the reliability of the grinding wheel 10 according to the present embodiment, the present inventor manufactured specimens Nos. 1–9 of grinding wheel of vitrified bond type, in the above-described process including the steps P10–P24. The specimens include different respective kinds of thermoplastic resin, namely, polyamide (nylon 66), polyester (PET) and polycarbonate (PC), as indicated in FIG. 3, and some of these specimens include alumina abrasive grains (WA) having a grain size # 100 as inorganic abrasives while the others do not include the inorganic abrasives, as also indicated in FIG. 3. Further, there were prepared comparative specimens Nos. 1–4 of grinding wheel of vitrified bond type all of which use the same abrasive material for the grinding portion 12 and the core portion 14. However, the abrasive materials used for the comparative specimens have different grain sizes (#100, #80, #60 and #46), as also indicated in FIG. 3. The specimens according to the present embodiment and the comparative specimens were subjected to a rotary destructive or breaking test, under the condition described below.

Condition of Rotary Destructive Test

Grinding wheel: WA 60 J 8V 35R
Dimensions of grinding wheel:
Outside diameter=205 mm
Inside diameter=50.8 mm
Thickness (Axial dimension)=19 mm
Outside diameter of core portion 14=136 mm
Peripheral speed of wheel=2000 m/min.

FIG. 3 also indicates the evaluated physical properties of the core portion of the grinding wheel 10 of each specimen, and safety factor values of the grinding wheels of the specimens obtained in the rotary destructive test. As described before, the material of the core portion 14 must have a specific tensile strength (tensile strength MPa divided by specific gravity) of at least 12 MPa, for the core portion 14 to exhibit a sufficiently high safety factor, that is, for the grinding wheel 10 to have a sufficiently high grinding capability. It will be understood from FIG. 3 that the compositions of the core portion 14 of all of the specimens Nos. 1–9 according to the present embodiment including polyamide (nylon 66), polyester (PET) or polycarbonate (PC) as a major component exhibited specific strength values of at least 12 MPa. The destructive or breaking test was conducted to detect the peripheral speed of the grinding wheel at which the grinding wheel was destroyed or broken. The safety factor is a value equal to the detected peripheral speed divided by the normal peripheral speed (2000 m/min.) at which the grinding operation is performed under a normal condition. The grinding wheel 10 is considered to be acceptable when it has a safety factor value of at least 2. FIG. 3 indicates that all of the grinding wheels according to the specimens Nos. 1–9 according to the present embodiment exhibited the safety factor values larger than 2. The comparative specimens Nos. 1–4 whose core portions are formed of vitrified abrasive grains as in the prior art grinding wheels exhibited acceptable safety factor values as expected.

To evaluate the grinding performance of the grinding wheel 10 of vitrified bond type according to the present embodiment, the present inventor manufactured a specimen No. 10, using the thermoplastic resin for the core portion 14, in the process illustrated in FIG. 2. Further, there was manufactured a comparative specimen No. 5 wherein alumina abrasives (WA) having a grain size #60 was used for both of the outer grinding portion and the inner core portion, as in the prior art. Grinding operations were performed by using these two specimens, to investigate the grinding ratio and surface roughness ($\mu$mRz) of the ground surface of the workpieces, and the amount of electric power consumption (W/mm) by the grinding machine. The grinding operations were performed under the condition described below.

Condition of Grinding Performance Test

Grinding wheel: WA60 J 8V 35R
Dimensions of grinding wheel:
Outside diameter=178 mm
Inside diameter=76.2 mm
Thickness (Axial dimension)=13 mm
Outside diameter of core portion 14=110 mm
Workpiece material: SUJ-2
Grinding liquid: Noritake-cool NK-88 (×50)
Grinding machine: Surface grinder available from Nikko (Japan)
Grinding mode: Wet plunge grinding
Peripheral speed of wheel=33 m/sec.
Worktable feed rate=0.33 m/sec.
Infeed amount=R10 $\mu$m/pass
Total grinding depth=3.0 mm Referring to FIG. 4, there is shown a result of the grinding performance test. It will be understood from FIG. 4 that the grinding wheel according to the present embodiment exhibited about 10% improvement in the grinding ratio, and a significant improvement in the surface smoothness of the ground surface of the workpiece, over those of the comparative specimen No. 5. It will also be understood that the required amount of electric power consumption by the grinding machine when operated with the grinding wheel according to the present embodiment is reduced by about 20%, with respect to that when the grinding machine was operated with the grinding wheel of the comparative specimen. These improvements are considered to be attributed to the property of the thermoplastic resin used for the core portion 14 of the grinding wheel 10 according to the present embodiment, more specifically, attributed to a higher degree of impact resistance of the thermoplastic resin or a higher function of absorbing vibrations generated in the grinding operation, than that of the conventional grinding wheel of vitrified bond type in which the same abrasive material is used for both of the grinding and core portions. Thus, it was confirmed that the grinding wheel 10 according to the illustrated embodiment of the invention, which can be reclaimed for recycling use of the materials of the grinding portion 12 and the core portion 14, is advantageous in the grinding ratio, surface smoothness and electric power consumption, over the prior art grinding wheel.

Figure 5:
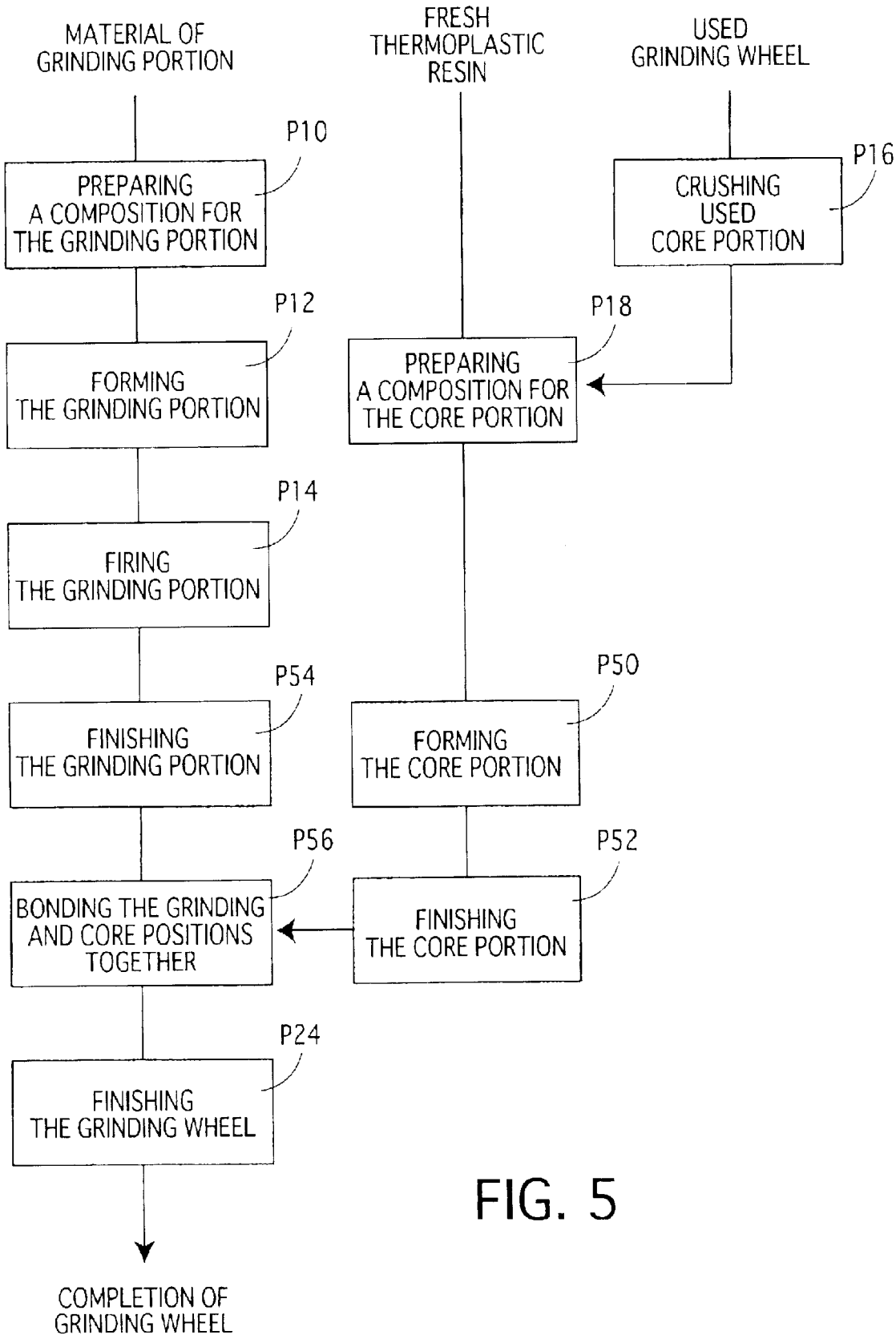
FIG. 5 is a flow chart illustrating a process of manufacturing a grinding wheel according to another embodiment of the present invention.

Referring next to the flow chart of FIG. 5, there will be described a second embodiment of this invention. In FIG. 5, the same reference signs as used in FIG. 2 will be used to identify the same process steps.

The flow chart of FIG. 5 illustrates a process of manufacturing the grinding wheel 10 according to the second embodiment of the invention. In step P50, a molten mass of the composition for the core portion 14 which has been prepared in step P18 is injected into a cavity of a core-forming mold in a closed position, at a sufficiently high temperature of the molten mass, so that the inner core portion 14 is formed, independently of the outer grinding portion 12. In the corresponding step P20 in the first embodiment of FIG. 2, the mold cavity is partially defined by the previously formed outer grinding portion 12 set in the lower half of the core-forming mold, so that the inner core portion 14 is formed integrally with the outer grinding portion 12, by injecting the molten mass of the appropriate composition into the mold cavity. In step P50 in the second embodiment of FIG. 5, the inner core portion 14 is formed separately from the outer grinding portion 12. Step P50 is followed by finishing step P52 in which the formed core portion 14 is cut at its outer surfaces by a suitable cutting tool, with a depth of cut of about 1–2 mm, so as to establish the nominal outside diameter, thickness, cylindricity, etc. In this respect, it is noted that the inner core portion 14 as formed in the core-forming step P50 have external dimensions which are larger than the nominal dimensions by the depth of cut in the finishing step P52.

On the other hand, the outer grinding portion 12 formed in the firing step P14 is subjected to a finishing operation in step P54 in which the grinding portion 12 is cut at the inner circumferential surface of its center hole by a dressing or cutting tool, with a depth of cut of about 1–2 mm, to establish the nominal inside diameter equal to the nominal outside diameter of the inner core portion 14. It is noted that the inside diameter of the outer grinding portion 12 as formed in the forming step P12 is smaller than the nominal value by the depth of cut in the finishing step P54. In the following bonding step P56, the outer grinding portion 12 and the inner core portion 14 are bonded to each other at their inner and outer circumferential surfaces, respectively, with a bonding agent, whereby the grinding wheel 10 is manufactured.

Figure 6:
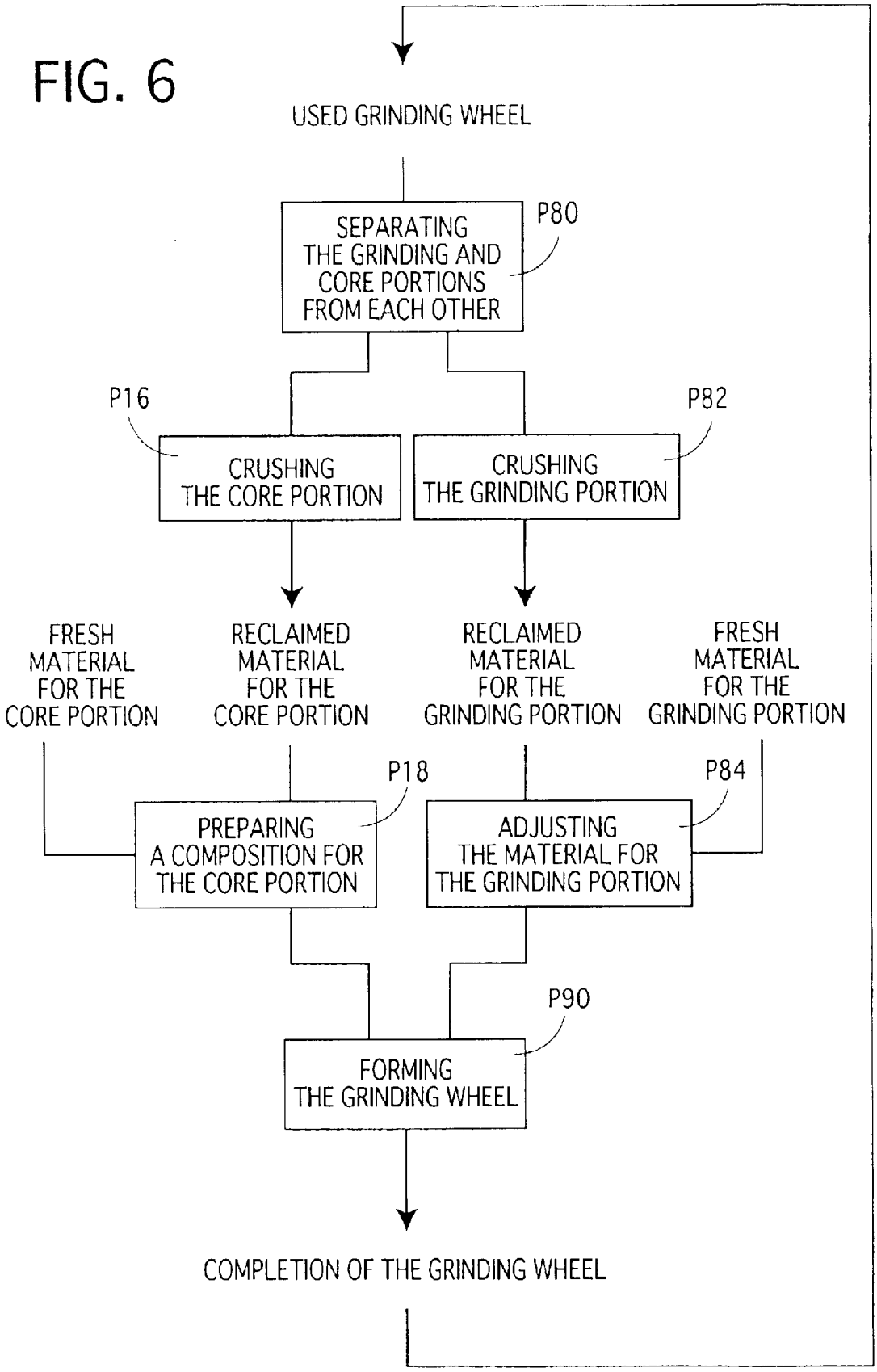
FIG. 6 is a flow chart illustrating a process of reclaiming the grinding wheel, according to a third embodiment of the invention.

In the processes of manufacturing the grinding wheel 10 according to the first and second embodiments of FIGS. 2 and 5, the grinding portion 12 and the core portion 14 of the used grinding wheel 10 are separated from each other, so that the core portion 14 is reclaimed as a part of the composition for the core portion 14 of the new grinding wheel. However, the outer grinding portion 12 of the used grinding wheel may also be reclaimed as a part of the composition for the grinding portion 12 of the new grinding wheel. An example of a process of manufacturing the new grinding wheel 10 by reclaiming the materials of the grinding portion 12 and the core portion 14 of the used grinding wheel is illustrated in the flow chart of FIG. 6. The process is initiated with step P80 in which the used or deteriorated grinding wheel is broken down into the outer grinding portion 12 and the inner core portion 14. In step P16, the thus obtained core portion 14 is crushed into pellets which are to be reclaimed for the core portion 14 of the new grinding wheel 10. The pellets are mixed with a fresh material for the core portion 14, in step P18, to prepare a composition for the core portion 14 of the new grinding wheel. Similarly, the outer grinding portion 12 separated from the core portion 14 in step P82 is crushed or ground into a mass of grains having a suitable size, which are to be reclaimed for the grinding portion 12 of the new grinding wheel 10. The mass of grains is mixed with a fresh material for the grinding portion 14, in step P84, to prepare a composition for the grinding portion 12 of the new grinding wheel 10. The thus prepared compositions are used to form the new grinding wheel 10 in wheel-forming step P90. The process according to the third embodiment permits recycling of the entirety of the grinding wheel 10.

As described above, the illustrated embodiments of FIGS. 2, 5 and 6 not only permit a manufacture of the grinding wheel 10 having the inner core portion 14 which has sufficiently high degrees of mechanical strength and durability, but also make it possible to reclaim the inner core portion 14 of the used grinding wheel 10, by separating the grinding and core portions 12, 14 of the used grinding wheel 10 from each other and crushing the core portion 14 into pellets and heating the pellets into a molten mass. The third embodiment of FIG. 6 further permits the grinding portion 12 of the used grinding wheel 10, by crushing the grinding portion 12 into grains of a suitable size. Accordingly, the required amounts of the fresh materials for forming the grinding and core portions 12, 14 of the new grinding wheel 10 are effectively reduced, so that the cost of manufacture of the grinding wheel 10 is reduced, owing to the complete recycling of the used grinding wheel. Further, the use of the thermoplastic resin for the core portion 14 is effective to improve the grinding ratio, smoothness of the ground surface of the workpiece, and electric power consumption economy, as described above, owing to the higher degree of impact resistance or vibration absorption capacity of the thermoplastic resin than the other materials such as abrasives, metals, and thermosetting resins. In this respect, the grinding wheel using the thermoplastic resin for the inner core portion according to the present invention is advantageous over the prior art grinding wheel using the above-indicated other materials for the core portion.

Further, the use of the fresh thermoplastic resin in addition to the reclaimed thermoplastic resin (the core portion 14 of the used grinding wheel 10 crushed into pellets) assures a sufficient mechanical strength of the core portion 14 of the new grinding wheel 10, while avoiding an increase in the material cost for the core portion 14 by reusing the thermoplastic resin of the used grinding wheel.

In addition, the thermoplastic resin used for the core portion 14 is selected from among engineering plastics commonly used for structural members, such as polyamide, polyester and polycarbonate, which have a specific strength of at least 12 MPa and high degrees of water and oil resistances. These engineering plastics are suitably used for the core portion 14. Typical grinding wheels of vitrified bond type are required to have a tensile strength of at least about 30 MPa, and have a specific gravity of about 2.5. Accordingly, the specific tensile strength of the typical grinding wheels is 12 MPa or larger. This means that the strength of the core portion 14 may not be enough to assure a satisfactory grinding performance of the grinding wheel 10, if the specific strength of the thermoplastic resin used as a major component of the core portion 14 is less than 12 MPa.

The core portion 14 preferably includes, as an aggregate, an inorganic filler such as a glass fiber and an abrasive material. The inclusion of the aggregate or inorganic filler in the core portion 14 enables the core portion 14 to exhibit strength and elastic modulus high enough to permit a grinding operation of the grinding wheel 10 under a severe condition at a peripheral speed as high as about 60 m/sec.

While the preferred embodiments of this invention have been described in detail by reference to the accompanying drawings, for illustrative purpose only, it is to be understood that the present invention may be otherwise embodied.

Although the present invention has been described above with respect to the grinding wheel 10 of vitrified bond type having the grinding portion 12 wherein the abrasive grains are held together with an inorganic bonding agent, the principle of the present invention is equally applicable to a grinding wheel of other types, such as a resinoid bond type wherein the abrasive grains of the grinding portion are held together with a synthetic resin, and a super-abrasive type wherein the grinding portion is formed of super-abrasives such as CBN abrasives or diamond abrasives.

In the present invention, thermoplastic resins of any kinds having a specific strength of at least 12 MPa may be used as a major component of the core portion 14, as well as those thermoplastic resins described above with respect to the illustrated embodiments, namely, engineering plastics such as polyamide (nylon 6, nylon 66), polyester (PET, PBT) and polycarbonate, quasi-engineering plastics such as AS (acrylonitrile-styrene resin), and commonly used resins such as polypropylene and polyethylene.

While the compositions for the core portion 14 according to some of the specimens indicated in FIG. 3 include an inorganic filler such as an abrasive material and a glass fiber, in addition to the thermoplastic resin used as the major component, for increasing the strength of the core portion 14, the inclusion of the inorganic filler is not essential. Further, various materials other than the inorganic filler may be added to the thermoplastic resin, provided that the content of the thermoplastic resin in the composition for the core portion 14 is large enough to permit the core portion 14 of the used grinding wheel to be heated to a molten state in which the thermoplastic resin is reclaimed.

In the first and second embodiments of FIGS. 2 and 5, the outer grinding portion 12 is press-formed in an annular shape in step P12 and then sintered in step P14, the outer grinding portion 12 need not be formed in an annular shape. Namely, the integrally formed annular grinding portion 12 may be replaced by a circular array of multiple abrasive segments each of which is formed of super-abrasives such as CBN abrasives or diamond abrasives held together with a vitrified, resinoid or metal bond and which are bonded to the outer circumferential surface of the inner core portion 14 with a suitable bonding agent.

It is to be understood that the present invention may be embodied with various other changes, modifications and improvements, which may occur to those skilled in the art, without departing from the spirit and scope of the invention defined in the following claims:

What is claimed is:

1. A grinding wheel comprising an outer annular grinding portion, and an inner core portion located radially inwardly of said outer annular grinding portion to support the outer annular grinding portion, said inner core portion being formed of a composition including as a major component a thermoplastic resin which has a specific tensile strength of at least 12 MPa, wherein said composition of said inner core portion includes a fresh thermoplastic resin, and a mass of pellets which is obtained by crushing the inner core portion of a grinding wheel formed of a composition including as a major component a thermoplastic resin.

2. A grinding wheel according to claim 1, wherein said thermoplastic resin is selected from a group consisting of engineering plastics including polyamide, polyester and polycarbonate.

3. The grinding wheel according to claim 1, wherein said composition of said inner core portion further includes, as an aggregate, an inorganic filler selected from a group including a glass fiber and an abrasive material.

4. The grinding wheel according to claim 1, wherein said outer grinding portion is a vitrified-bond grinding portion having a porous structure of abrasive grains bonded together with an inorganic bonding material.

5. The grinding wheel according to claim 4, wherein said porous structure is impregnated at an inner circumferential surface with the thermoplastic resin of said composition of said inner core portion.

6. A grinding wheel comprising an outer annular grinding portion, and an inner core portion located radially inwardly of said outer annular grinding portion to support the outer annular grinding portion, said inner core portion being formed of a composition including as a major component a mixture of a fresh thermoplastic resin and a reclaimed thermoplastic resin.

7. The grinding wheel according to claim 6, wherein said mixture has a specific tensile strength of at least 12 MPa.

8. A grinding wheel comprising an outer annular grinding portion, and an inner core portion located radially inwardly of said outer annular grinding portion to support the outer annular grinding portion, said inner core portion being formed of a composition including as a major component a thermoplastic resin, said composition further including, as an aggregate, an inorganic filler selected from a group including a glass fiber and an abrasive material.

9. The grinding wheel according to claim 8, wherein said thermoplastic resin has a specific tensile strength of at least 12 MPa.

10. The grinding wheel according to claim 8, wherein said composition including a mixture of a fresh thermoplastic resin and a reclaimed thermoplastic resin.

* * * * *